United States Patent [19]

Eigenmann

[11] 3,996,556

[45] Dec. 7, 1976

[54] LIGHT EMITTING MARKER FOR ROADWAY PAVEMENTS, FOR TRAFFIC SAFETY

[76] Inventor: Ludwig Eigenmann, Vacallo, Ticino, Switzerland

[22] Filed: Apr. 4, 1974

[21] Appl. No.: 457,755

[30] Foreign Application Priority Data

Apr. 9, 1973 Italy ..... 22751/73
June 28, 1973 Italy ..... 25989/73

[52] U.S. Cl. ..... 340/117; 404/14; 340/114 R

[51] Int. Cl.[2] ..... E01F 9/00

[58] Field of Search ..... 340/117, 114 R, 61; 404/9, 14, 72; 156/526, 551; 250/458, 462

[56] References Cited

UNITED STATES PATENTS

| | | | |
|---|---|---|---|
| 1,981,206 | 11/1934 | Strauss | 340/117 |
| 2,093,642 | 9/1937 | Nystuen | 340/117 |
| 2,162,302 | 6/1939 | Greene | 340/117 |
| 2,489,499 | 11/1949 | Pellar | 404/16 |
| 3,319,542 | 5/1967 | Bergshor-Hansen | 404/16 |
| 3,566,125 | 2/1971 | Linhart, Jr. | 250/462 |
| 3,587,415 | 6/1971 | Eigenmann | 404/9 |

*Primary Examiner*—John W. Caldwell
*Assistant Examiner*—Donnie L. Crosland
*Attorney, Agent, or Firm*—Michael J. Striker

[57] ABSTRACT

A traffic safety aid consists of a prefabricated essentially flexible marking tape material which is adapted to be laid on and adhesively secured to a roadway surface, at predetermined locations which are to be detected and identified at a distance by a driver of a vehicle. The tape material has an upper face, a plurality of protrusions spaced lengthwise of the upper face. Each protrusion has the capability of emitting visible light when energy is applied thereto. Each protruse may contain a luminescent substance adapted to emit visible energy when excited by invisible or not visible radiations, or electric sources adapted to emit visible light when electric energy is applied through insulated leads prearranged in the tape material.

6 Claims, 5 Drawing Figures

LIGHT EMITTING MARKER FOR ROADWAY PAVEMENTS, FOR TRAFFIC SAFETY

BACKGROUND OF THE INVENTION a. The Field of the Invention

This invention relates to the art of forming traffic regulating signs or markers on roadway pavements and, more particularly, to providing a roadway pavement with traffic regulating and facilitating means including light emitting spots that are capable of positively visualizing delineations and other signs on the surface area of such pavement.

B. The prior Art

Traffic regulating indicia formed on roadway pavements and forming a part of the roadway area thereof, such as traffic lane dividing lines, roadway edge defining lines, pedestrian crossing areas signalling strips and so on, are widely known, and comments are unnecessary about the importance of such indicia. The position of such indicia on the roadway surface, their shape and also their color are prescribed by traffic regulations. Traffic safety largely depends upon the fact that such indicia should be visible to the driver well far in advance of the position of the vehicle.

Various methods have been devised for providing such indicia. Conventionally, lane separations and other signs are formed by painting them on the surface of the roadway pavements. Other methods involve pouring and doctoring on said surface a layer of settable pigmented composition. An advantageous method comprises factory manufacturing a tape material adapted to be adhesively secured on the roadway pavement surface and then applying and securing the tape at the desired locations on the roadway pavement. Various procedures and machines have been proposed for expediting the forming of the desired delineation or indicium along traffic carrying roadway areas.

A vast patent literature describes several embodiments of this latter art. The U.S.A. Pat. Nos. 3,007,838, 3,235,437 and 3,262,375, of the present applicant, are a few examples of such literature relating to the application of preformed roadway pavement marking tape materials for forming the above described indicia.

The prior art has also thoroughly considered the problems involved with the visibility of the so formed indicia, and particularly at nighttime when the substantially sole source of illumination is provided solely by the vehicle headlamps, that is by a source of light, the rays of which impinge on the marker surface at spots well far in advance of the position of the vehicle, and travel in a direction which forms either a small or a very small angle with the generally planar surface of the indicium. It is known that, in such an occurrence, the visibility of the indicium is provided only by the retrocollimated rays which are reflected back essentially along their own incident rays. As a matter of fact, at the distance at which a part of an indicia on the roadway pavement would be clearly visible and unmistakably detected by the driver, the position of the source of light (the vehicle headlamps) is very close to that of the driver's eyes. These visibility problems are further aggravated by rainy weather, especially when a mirror-like film of water is formed upon the roadway surface and prevents the necessary retrocollimation.

In the U.S.A. Pat. No. 3,587,415, also of the present applicant, useful means for consistently solving at least part of the above considered problems have been described. A mode for providing retrocollimating elements of improved efficiency has been also taught by the present applicant in his U.S.A. Pat. No. 3,746,425.

It is further however known that, even by taking advantage of the most suitable and efficient light retrocollimating means, the amount of the light which can be reflected back which actually reaches the driver from a spot safely far ahead of the vehicle, is a tiny fraction of one thousandth of that emitted by the source of light on the vehicle. The light travels a distance which is twofold that of the interval between the driver's eyes and the spot in sight. The maximum length of this interval, from which the traffic safety margin largely depends, is a function of a marginal brilliancy value. This important distance will be hereinafter termed "safety visibility distance" as far as this invention is concerned.

This safety distance is acknowledgedly influenced by the transparency of the atmosphere. In hazy and, more particularly, in foggy weather, this distance is drastically reduced towards zeroe, and the driver can hardly follow the proper path midway of the traffic lane, as well as dangerously delaying his detection of obstructions. This poor visibility is aggravated by the same light issuing from the vehicle headlamps, because such light is scattered and refracted by the tiny water droplets which form the fog, and a dazzling "white wall" apparently faces the driver. This dazzling light, reflected by the same atmosphere, cancels the dim lights retroreflected by retrocollimating means with which the traffic regulating signs on the roadway pavement are, provided.

Light emitting markers can provide a great deal better visibility. It is known that sources of light, such as aligned electric or fuel torches, are made use of for channeling and guiding traffic in emergency and in foggy weather. Illuminated traffic buttons and raised bars have been proposed and made use of. Such sources of light cannot however occupy the roadway area, nor can they properly complement the statutory indicia formed on the roadway pavements. Moreover, they cannot provide dazzling guide means which can be safely followed by drivers in poor visibility conditions.

It is therefore an object of this invention to provide a new and useful material which can be associated with a roadway pavement for providing thereon visible traffic regulating markers which are not subject to the above and other limitations and objections, thus sharply improving the traffic safety.

SUMMARY OF THE INVENTION

According to the broadest aspect of the invention, there is provided a tape material which is adapted to be laid on and firmly secured to a roadway pavement to form a part of the roadway surface thereof. Protrusions are spaced along the up-turned face of the tape material on said pavement, each protrusion forming a light emitting means when selectively activated by applying energy to potential sources of light housed into and protected by said protrusions.

According to one embodiment of the invention, each protrusion comprises a luminescent substance adapted to issue visible light when impinged by radiating energy. According to another embodiment, the tape material comprises insulated leads connected to a source of electrical energy for applying either excitating electrical energy to said light emitting means, such as a photo-electro-luminescent substance, to provide an exciting electric field therefor, or activating electric energy to said light emitting means, such as an excitable diode, a small glow lamp or a small filament lamp.

According to the principle of the invention, the light emitting means are selectively activated by applying energy thereto only when weather or other low visibility promoting conditions are present. The tape material itself to which such means are associated can form part of a statutory sign or marker on the roadway pavement, such as a lane delineating strip, or form no part of the sign, such as non-marked segment or interval of a segmented traffic lane dividing line. In such occurrence or location, the tape material is of a color equal or similar to that of the adjacent non-marked area of the pavement.

By providing a tape material having an upper face of a nuetral color (that is, of a color essentially not distinct from that of the non-marked areas of the pavement), such tape material can be advantageously made use of, according to another advantageous feature of the invention, to form an alignment of dim light spots, to be activated only when necessary, in the middle of the traffic lane, to delineate the proper path to be followed by a vehicle when driven in foggy weather conditions. This alignment of light sources to be followed by a vehicle in foggy weather provides a great deal more efficient and safer guide than that provided by conventional roadway edge delineations from which a vehicle must travel spacedly in a lateral direction. This special service of a "fog-line" as a guide for a driver can be discriminated by the color (such as green or orange) of the selectively emitted light, so that the driver is aware that he is following the "fog-line" and not a regular traffic lane edge or dividing line.

A tape material designed for the above special service can be advantageously provided with light emitting means consisting of luminescent substances adapted for emitting visible light when excited by visible and non-visible light. Such substance are known and available commercially, for example, pigments such as those sold by the Firm Riedel & De Haen (Hannover Germany) under the trade names "Orange Red N"or "Grun M5," or by the Firm Chance-Pilkington under the trade names "OB 10 Blue," "OB14" or "OV 1 Porpora." The vehicles can be advantageously provided with fog lamps capable of or screened for emitting a powerful beam of non-visible light, such as untraviolet radiation, for exciting such light emitting means. The non-visible light does not evidently promote any "dazzling effect" in the foggy atmosphere, in contrast to the effect caused by visible light. Any light emitted by the excited pigments is visible for detection by a driver, and the spacing and location of the illuminated spots will define the safe path to be followed. In such an occurrence, the tape material can be made, at its upper face, of a color distinct either from that of the adjacent non-marked pavement or from that of the regular and statutory markers existing on the same roadway pavement, so that the driver can unmistakably discriminate the "fog-line" forming material from the other indicia to be statutorally obeyed. The driver is thus made aware of the availability of the means designed for providing him with a sure guide for driving through the fog, and consequently of reminding him to activate the luminescency exciting lamp, when necessary.

These and other advantageous features and objects of the invention will be made best apparent from the following detailed disclosure of several embodiments thereof with reference being made to the accompanying drawing.

DETAILED DESCRIPTION OF THE PREFERRED EMBODIMENTS

Figure 1:
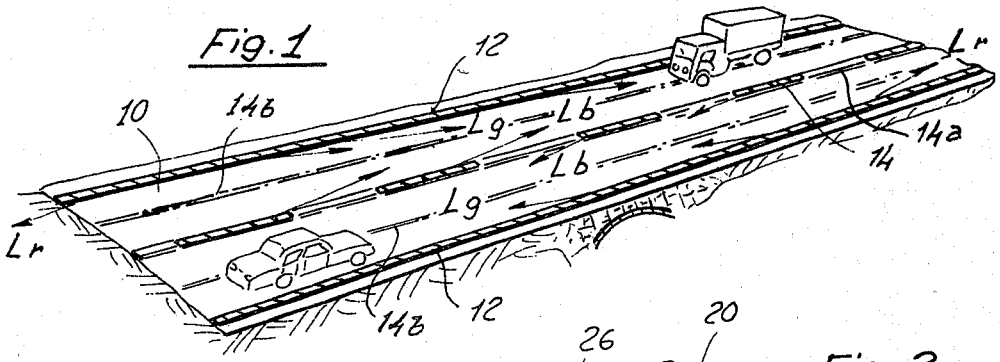
FIG. 1 is a fragmentary perspective diagrammatical view of a roadway provided with a plurality of variously arranged tape materials according to the invention.

In FIGS. 1, 2, 4 and 5, numeral 10 generically indicates the roadable surface of a roadway. For simplicity, FIG. 1 illustrates a somewhat secondary roadway for two-way traffic, the roadable area of which is laterally defined by edge delineating continuous lines 12, and provided at its midway with a traffic dividing line 14. Such lines are conventionally identifiable by color, according to the regulations (in general, edge lines 12 are yellow, and the traffic lane dividing line 14 is white). The view of FIG. 1 is assumed to illustrate a roadway length where lane-changing or overtaking is permitted, if unobstructed by opposite traffic. This permission is signalled by the fact that the center line 14 is segmented, that, is it consists of an alignment of marked lengths spaced by unmarked intervals such as indicated at 14a. For safe traffic, a driver should discriminate, well far in advance of the vehicle, the edge lines (such as at 12) from the traffic lane dividing lines (such as at 14) and detect whether such lane dividing line or lines is or respectively are continuous or segmented (as shown).

When no visibility problems exist, properly colored and not excessively worn indicia on a roadway pavement are clearly seen and identifiable. The invention provides a substantial contribution to traffic safety under low and even under the lowest visibility conditions, and it will now be assumed that the visibility of any of the above lines will be made according to the invention. This assumption is however not critical for the invention, because only a part of such lines (or of other lines or signs, as explained below) need be provided by applying the principle of the invention.

Any of such lines (or other sign formed on a roadway pavement) is made of tape material provided with protrusions at least a part of which is capable, when energy is applied thereto, of emitting visible light focalized into a beam directed towards the vehicles traveling along the roadway lane which is adjacent to the associated linear marking. The light emitting protrusions on traffic regulating markings complement the visibility of such markings, when defective.

Therefore, the edge delineating markings 12 are complemented with protrusions capable of emitting beams of yellow light directed as indicated by arrows Lg, while the protrusions associated with the lengths of the center segmented line 14 will emit, when activated by energy, beams of white light beams directed as indicated at Lb. In low visibility conditions, the driver will therefore be signalled by light color detection whether the path of the vehicle is approaching too much towards the edge or the center of the roadway.

Further, an inadvertent crossing of the center line 14 and an extremely dangerous close approach to the off-hand edge of the road might also be signalled by providing protrusions along the edge delineating tape materials at 12 which are adapted for emitting, when energy is applied thereto, beams of red light, as indicated at Lr, which can be seen only when travelling on the wrong side of the road.

When the protrusions are associated with tape materials which form also regular and statutory markings on the road pavement, such light emitting protrusions are normally arranged on the marking parts of the tape only. For facilitating the laying down of the tape, and for other reasons as explained below, the tape material can advantageously be uninterrupted and form, for example, the unmarked intervals 14*a* of a segmented lane dividing line. In such portions the tape is prefabricated so that its upper face is not neatly distinct, by color, from the roadway surface 10. The tape material can be factory prefabricated with upper layers pigmented or otherwise colored. Alternate portions of a prescribed color and respectively of a neutral color form the marking lengths 14 and respectively the intervals 14*a*.

An important feature of the invention, therefore, comprises prefabricated a tape material adapted to be laid on and secured to a roadway pavement so that it has an upper face of neutral or other color such that the applied tape does not form part of the statutory traffic regulating indicia on the roadway pavement. Another feature provides the pavement with spaced protrusions capable of emitting light beams of a given color in a given direction when energy is applied thereto, that is if and when desired or required.

This provision makes feasible special, new and very important signalling means, such as the "fog-lines" above indicated. Tape materials of this character are shown at 14*b* in FIG. 1 in phantom lines in order to indicate that such tape materials are not actually seen by a driver in the daytime and generally at those times when the visibility is good. Alternatutory, the fog lines 14*b* are at least distinct from the regular and statutory signals of the roadway and, therefore, they are not misleading as far as traffic regulation is concerned. From the point of view of regular traffic regulation, therefore, such lines indicated at 14*b* can be considered as not existing.

These lines 14*b* are formed on the road surface 10 at the middle of the traffic lanes divided by the segmented statutory marking line 14. More properly, the fog-lines 14*b* are positioned to define the most proper and safest path to be followed by a vehicle which correctly keeps to its own side of the road. These lines 14*b* are formed by a tape material having protrusions adapted for selectively emitting, when energy is applied thereto, light beams of a color distinct from that of any other signalling means, such as green or yellow-green.

When such a new signalling means is available (its availability can be signalled by its color, such as green, for example), it can be activated in foggy weather only, for example, and it provides, in such an acknowledgedly dangerous weather situtation, a path guide which can be easily and surely followed by a driver who drives his vehicle straight over and straddles the alignment of the green (for example) light spots which successively appear ahead of him.

As far as the dimensions and the spacing of the protrusions which are associated with the tape material are concerned, such parameters can be widely varied. In general, each protrusion can be of generally convex configuration and of such height above the upper face of the tape material so that no dangerous jerks or vibrations can be induced in even a very fast vehicle which travels thereon. The teachings taken from the disclosure of U.S.A. Pat. No. 3,587,415 can be made use of therefor.

When the light emitting means associated with a respective protrusion consists of visible light or ultraviolet radiation which can actuate luminescent pigments and substances, such pigments or substances can be added to the resinous binder of the aggregate which forms the protrusion of the material described in said latter patent literature or in any other known manner. How proper light-focusing aggregates can be formed and arranged, and the selection of a proper luminescent substance is well within the common knowledge of the art and therefore further details thereof are believed to be unnecessary.

In FIGS. 2, 3, 4 and 5, preferred modes designed for providing a new tape material having protrusions including electrically excitable or activable light emitting means are shown. The tape material, when individually considered, is prefabricated by superimposing and integrally joining two layers 22 and 24 of known resinous based compositions, such as those described by the above identified patent literature or, preferably, in my prior Canadian Pat. No. 929,698 (corresponding to French Pat. No. 2,097,941). The upper layer 22 is especially designed for providing the most desirable resistance to traffic wear, and it is suitably pigmented for providing an upper face 20 of the required color, either of significance for traffic regulation, or of a neutral or a distinct color, in view of the reasons and objects indicated above. The lower layer 24 has for its principal object to provide a firm and permanent bond between the upper layer 22 and the surface 10 of the roadway pavement, also according to the art.

Figure 2:
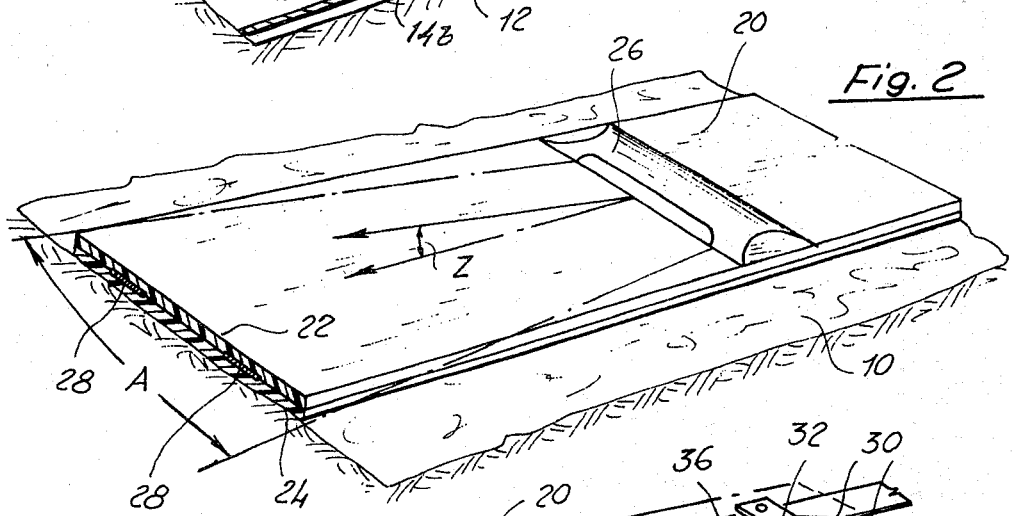
FIG. 2 is a fragmentary perspective view which illustrates in greater detail a portion of one of said tape materials.
Figure 5:
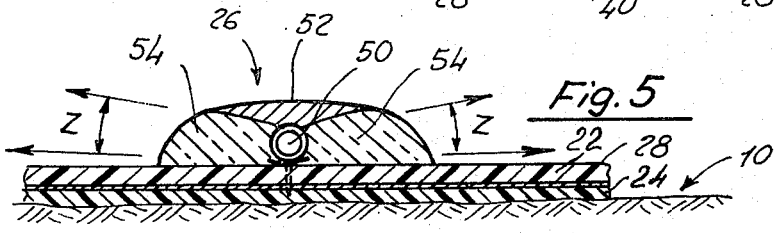
FIG. 5 is a longitudinal sectional view of a preferred embodiment of a protrusion housing an electrically activated elongated lamp.

The protrusions 26 (FIGS. 2 and 5 provide preferred examples of their configuration) are secured by known adhesive material to the upper face 20 of the tape. If desired, the bond can be improved by slightly embedding the protrusion 26 in the thickness of the tape. Electrical leads are pre-arranged and embedded within the tape. Such leads preferably consist of a pair of flexible metal strips 28 arranged and closed in parallel and spaced relationship between the layers 22 and 24. The proper insulation between the strips 28 is generally ensured by the fact that the known resin-based compositions, of which such traffic regulating signs are usually formed, are quite electrically insulating. If expedient, the conductive strips 28 can be previously coated with an insulation layer, such as a known insulating enamel coating, so that the insulation is ensured even if the upper layer 22 would be cracked or otherwise damaged by traffic.

Figure 3:
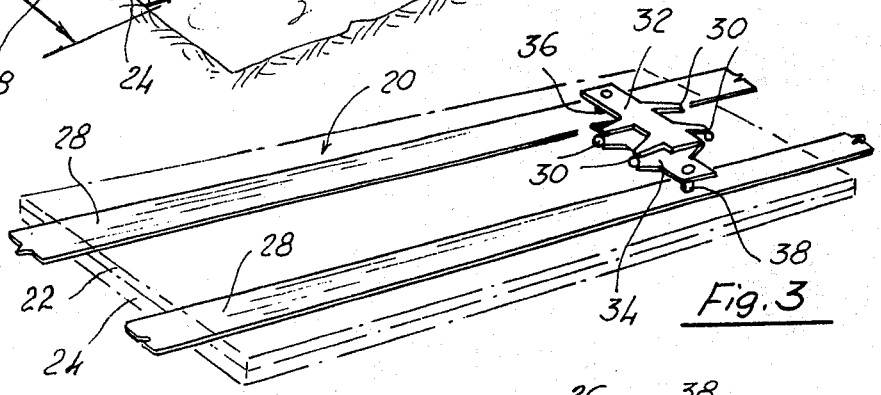
FIG. 3 is a view similar to that of FIG. 2, but in which the components of the tape materials and of a protrusion are shown by phantom lines so that internal components can be seen.

In the embodiment of FIG. 3, the electrically activated source of light consists of well-known small diodes 30, or glow lamps, which have both of their terminals respectively connected to metallic, shaped plates 32 and 34 which are, in turn, individually connected to one, and respectively to the other lead strip 28. A preferred mode for making this connection comprises securing to the side end portions of said plates 32 and 34, sharpened metallic points or nails 36, 38 which are spaced from each other, as the strips 28 are, and are forcedly driven through the tape material until puncture and engage the strips 28. The electrically-conductive and light emitting components of the protrusion are 26 fully encased and secured within a die cast body of an insulating resin, the said body being at least partially transparent.

The provision of prefabricated protrusions having an upper convex surface and a flat bottom face, from which the nails 36, 38 downwardly depend, facilitates the positioning of the protrusions on an already laid tape material. Moreover, broken or otherwise ineffective protrusions can be easily interchanged during the routine maintenance of the roadway.

Preferably, each protrusion comprises a rigid stress and shock resistant body including transparent and non-transparent components. The transparent components form a focusing lens system adapted to focus and concentrate the emitted visible light into a flat low beam adjacent to the tape upper face 20 and therefore to the road surface 10. As indicated in FIG. 2, such a beam has a lateral angular width or amplitude A preferably comprised from 5° to 10° , and a vertical angular height or amplitude Z preferably from 2° to 5° . To limit the width and height of the emitted visible light beam has a twofold advantage: the light emission is used best when it is concentrated in the direction from which the signal is to be seen by a driver without an undue dissipation of energy, and the light cannot be seen from a position different from that occupied by a driver for whom only the signal is of interest and for whom the visibility of misleading lights by drivers travelling in other directions or along other lanes is prevented. It is important that the vertical elongation of the beam will not exceed 10° (and preferably less) to prevent a dazzling effect by an illuminated protrusion which is too close in advance of the vehicle.

Figure 4:
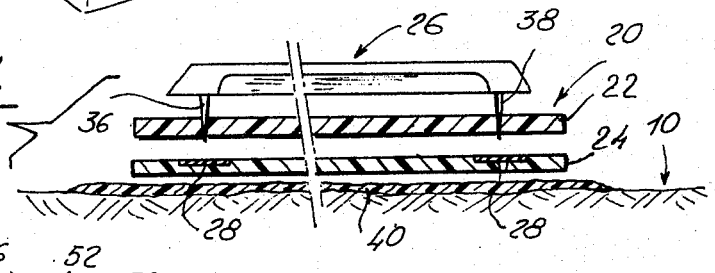
FIG. 4 is a cross-sectional exploded view of the tape material of FIG. 2.

FIG. 4 illustrates the combination of the essential components of the tape material. Preferably, this tape material is fully prefabricated prior to its being laid on the road surface 10, which is, in turn, preferably prepared by spreading and doctoring thereon a primer layer 40 that is impervious to water. In the event of repair or maintenance of the road pavement, or when otherwise expedient, the protrusions 26 can be supplied upon an already laid and set tape material, or the same material can be formed upon the road surface 10. In such latter occurrence, the lower layer 24 might also be formed integrally with the primer layer 40, and the lead strips 28 can be placed therein before applying the upper layer 22. This procedure is useful, for example, where the color of the upper face 20 of the tape, that is the color (either significant or neutral) of the upper layer 22 is to be selected at the very location where the material is to be made use of and set on the roadway pavement.

A protrusion, according to the embodiment of FIG. 5, wherein 50 indicates the position of a suitable source of light (a small elongated electric lamp, for example), has a composite structure, comprising an upper armor portion 52, preferably of the drawn metal, and transparent symmetrical portions 54, preferably of drawn or die cast resin. The component is designed for emitting oppositely directed light beams of same color (such as for center line strips as at 14, FIG. 1) or of different colors, such as described for edge delineations 12. The color of the emitted light is provided by coloring the transparent components 54.

The transparent components 54 are cross-sectionally shaped, in vertical planes lengthwise of the tape material on which the protrusions are transversally arranged, to form part-cylindrical lenses for converging and focusing the emitted visible light into the desired vertical elongated Z. Focusing by shaping the reflective surface, refractive means and other well known means can be obviously provided for by those skilled in the art for the most efficient focusing of the light and/or for improving the rigidity and/or the mass production and assembling of said components.

I claim:

1. In a roadway surface marking tape material, a composite tape structure comprising a base strip component superimposed and firmly secured to a roadway surface to form a traffic aid thereon and having an upper face; a plurality of protrusions distributed lengthwise along said upper face at any of a plurality of predetermined locations thereof; means of emitting light comprised of electrically actuable light sources in said protrusions for signalling said predetermined locations of said protrusions to a user; a pair of elongated strip-shaped leads in said composite tape structure for electrically connecting said electrically actuable light sources to a supply of electrical energy; and means for electrically connecting said electrically actuable light sources to said leads at any of said plurality of predetermined locations in direction of the elongation of said leads, said connecting means including conductive spikes for puncturing said base strip component and making direct electrical contact with said leads at a selected one of said predetermined locations.

2. The surface marking material of claim 1, wherein said upper face is colored so as to signify conventional traffic regulation signals.

3. The surface marking material of claim 1, wherein said tape structure is flexible and continuous, and said upper face thereof is alternately colored and uncolored, whereby a person travelling along the roadway can identify traffic lanes.

4. The surface marking material of claim 1, wherein said protrusions comprise means for focussing the light emitted by said light-emitting means into a beam of predetermined width and height.

5. The surface marking material of claim 4, wherein said focussing means is a lens integrally formed with each of said respective protrusions.

6. The surface marking material of claim 1, wherein said base strip component comprises two juxtaposed electrically insulating layers, and wherein said pair of leads is sandwiched between said layers; and wherein said conductive spikes puncture said layers.

* * * * *